US011651708B1

(12) United States Patent
Kraft et al.

(10) Patent No.: US 11,651,708 B1
(45) **Date of Patent: *May 16, 2023**

(54) COMBINATION WRISTBAND AND LABEL FORM

(71) Applicant: Ward-Kraft, Inc., Fort Scott, KS (US)

(72) Inventors: Roger Kraft, Fort Scott, KS (US); Gina Staudinger, Louisburg, KS (US); Roger Davis, Garland, KS (US)

(73) Assignee: Rekon, LLC, Pittsburg, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/307,622

(22) Filed: May 4, 2021

Related U.S. Application Data

(63) Continuation of application No. 16/418,723, filed on May 21, 2019, now Pat. No. 10,997,874, which is a continuation-in-part of application No. 15/403,922, filed on Jan. 11, 2017, now Pat. No. 10,297,170, which is a continuation of application No.
(Continued)

(51) Int. Cl.

| | |
|---|---|
| ***G09F 3/00*** | (2006.01) |
| ***G09F 3/10*** | (2006.01) |
| *G09F 3/02* | (2006.01) |

(52) U.S. Cl.
CPC ..... *G09F 3/005* (2013.01); *G09F 3/10* (2013.01); *G09F 2003/0201* (2013.01); *G09F 2003/023* (2013.01); *G09F 2003/0219* (2013.01); *G09F 2003/0226* (2013.01); *G09F 2003/0277* (2013.01)

(58) Field of Classification Search
CPC ... G09F 3/02; G09F 3/005; G09F 3/10; G09F 2003/0277; G09F 2003/0219; G09F 2003/023; G09F 2003/0201; G09F 2003/0226; G09F 3/14; A44C 5/00
See application file for complete search history.

(56) References Cited

U.S. PATENT DOCUMENTS

| | | | |
|---|---|---|---|
| 230,455 | A | 7/1880 | Wilcox |
| 919,983 | A | 4/1909 | Walsh |
| 922,948 | A | 5/1909 | Portmore |

(Continued)

FOREIGN PATENT DOCUMENTS

| | | | |
|---|---|---|---|
| DE | 1039431 | B | 9/1958 |
| EP | 0996106 | A1 | 4/2000 |

(Continued)

OTHER PUBLICATIONS

Final Office Action, dated Jul. 8, 2021, 9 pages, issued in U.S. Appl. No. 17/013,065.

(Continued)

*Primary Examiner* — Cassandra Davis
(74) *Attorney, Agent, or Firm* — Avek IP, LLC

(57) ABSTRACT

A combination wristband and label form. The form has a front sheet and a back sheet. The front sheet has a void. The back sheet has a wristband die cut therein and separable therefrom. The wristband has a printable portion and a laminating portion. The printable portion is coated with ink that faces away from the back sheet. The wristband is devoid of paper. The printable portion is configured to be printed through the void while the wristband is attached to the combination wristband and label form.

8 Claims, 11 Drawing Sheets

Related U.S. Application Data

15/339,105, filed on Oct. 31, 2016, now Pat. No. 10,249,221.

(60) Provisional application No. 62/257,086, filed on Nov. 18, 2015, provisional application No. 62/256,465, filed on Nov. 17, 2015, provisional application No. 62/247,863, filed on Oct. 29, 2015.

(56) References Cited

U.S. PATENT DOCUMENTS 1,039,431 A 9/1912 Moore
1,383,335 A 7/1921 Penksa
1,517,456 A 12/1924 Pulliam
2,054,227 A 9/1936 Nichols
2,073,280 A 3/1937 Lederer
2,553,676 A 5/1951 Roos
2,641,074 A 6/1953 Richmond
2,687,978 A 8/1954 Vogt
2,914,166 A 11/1959 Bihler
3,153,869 A 10/1964 Twentier
3,197,899 A 8/1965 Twentier
3,402,808 A 9/1968 Yannuzzi
3,517,802 A 6/1970 Patrick
3,585,743 A 6/1971 Jeffers
3,660,916 A 5/1972 Mcdermott et al.
3,854,229 A 12/1974 Morgan
4,004,362 A 1/1977 Barbieri
4,078,324 A 3/1978 Wiebe
4,138,234 A 2/1979 Kubesa
4,179,833 A 12/1979 Knodel
4,226,036 A 10/1980 Krug
4,233,715 A 11/1980 Mcdermott
4,314,415 A 2/1982 De Woskin
4,318,234 A 3/1982 Charles et al.
4,370,370 A 1/1983 Iwata et al.
4,565,731 A 1/1986 Komatsu et al.
4,612,718 A 9/1986 Golub et al.
4,627,994 A 12/1986 Welsch
4,630,384 A 12/1986 Breen
4,682,431 A 7/1987 Kowalchuk
4,696,843 A 9/1987 Schmidt
4,783,917 A 11/1988 Smith et al.
4,829,604 A 5/1989 Allen et al.
4,854,610 A 8/1989 Kwiatek
4,855,277 A 8/1989 Walter
4,914,843 A 4/1990 Dewoskin
4,941,210 A 7/1990 Konucik
4,950,638 A 8/1990 Yuyama et al.
4,956,931 A 9/1990 Selke et al.
D312,654 S 12/1990 Giordano
4,978,144 A 12/1990 Schmidt et al.
4,991,337 A 2/1991 Solon
RE33,616 E 6/1991 Welsch
5,026,084 A 6/1991 Pasfield
5,031,382 A * 7/1991 Boyle ..... B42D 15/08 493/216
5,045,426 A 9/1991 Maierson et al.
5,048,870 A 9/1991 Mangini et al.
5,103,583 A * 4/1992 VanErmen ..... G09F 3/02 283/81
5,135,789 A 8/1992 Schmidt
5,222,823 A 6/1993 Conforti et al.
5,227,004 A 7/1993 Belger
5,227,209 A 7/1993 Garland
5,283,969 A 2/1994 Weiss
5,311,689 A 5/1994 Lindsey
5,318,326 A 6/1994 Garrison
5,331,140 A 7/1994 Stephany
5,351,993 A 10/1994 Wright et al.
5,364,133 A 11/1994 Hofer et al.
5,370,420 A 12/1994 Khatib et al.
5,381,617 A 1/1995 Schwartztol et al.
5,383,686 A 1/1995 Laurash
5,395,667 A 3/1995 Ohno et al.
5,401,110 A 3/1995 Neeley
5,418,026 A 5/1995 Dronzek, Jr. et al.
5,421,942 A 6/1995 Hoffmann
5,423,574 A 6/1995 Forte-Pathroff
5,427,416 A 6/1995 Birch
5,448,846 A 9/1995 Peterson et al.
5,457,906 A 10/1995 Mosher, Jr.
5,486,021 A 1/1996 Laurash
5,486,436 A 1/1996 Dale
5,509,693 A 4/1996 Kohls
5,509,694 A 4/1996 Laurash et al.
5,518,787 A 5/1996 Konkol
5,524,934 A 6/1996 Schwan et al.
5,547,227 A 8/1996 Laurash et al.
5,560,657 A 10/1996 Morgan
5,562,789 A 10/1996 Hoffmann
5,581,924 A 12/1996 Peterson
5,586,788 A 12/1996 Laurash
5,595,404 A 1/1997 Skees
5,596,202 A 1/1997 Arakawa
5,598,970 A 2/1997 Mudry et al.
5,601,222 A 2/1997 Haddad
5,601,313 A 2/1997 Konkol et al.
5,630,627 A 5/1997 Stewart
5,637,369 A 6/1997 Stewart
5,648,143 A 7/1997 Mehta et al.
5,653,472 A 8/1997 Huddleston et al.
5,662,976 A 9/1997 Popat et al.
5,670,015 A 9/1997 Finestone et al.
5,687,903 A 11/1997 Akridge et al.
5,721,178 A 2/1998 Lalande
D391,991 S 3/1998 Conner
5,752,722 A 5/1998 Moore et al.
5,765,885 A 6/1998 Netto
5,785,354 A 7/1998 Haas
5,837,337 A 11/1998 Schnitzer
5,837,341 A 11/1998 Johnstone
5,840,143 A 11/1998 Swanson
5,842,722 A 12/1998 Carlson
5,877,742 A 3/1999 Klink
5,933,993 A 8/1999 Riley
5,984,363 A 11/1999 Dotson et al.
6,000,160 A 12/1999 Riley
6,006,460 A 12/1999 Blackmer
6,016,618 A 1/2000 Attia et al.
D423,044 S 4/2000 Burke et al.
6,053,535 A 4/2000 Washburn et al.
6,055,756 A 5/2000 Aoki
6,058,639 A 5/2000 Tinklenberg et al.
6,067,739 A 5/2000 Riley
6,071,585 A 6/2000 Roth
6,092,321 A 7/2000 Cheng
6,108,876 A 8/2000 Hubbert
6,155,476 A 12/2000 Fabel
6,155,603 A 12/2000 Fox
6,159,570 A 12/2000 Ulrich et al.
6,199,730 B1 3/2001 Chisolm
D448,404 S 9/2001 Hamilton et al.
6,303,539 B1 10/2001 Tony
6,331,018 B1 12/2001 Roth et al.
6,343,819 B1 2/2002 Shiozaki
6,361,078 B1 3/2002 Chess
6,364,366 B1 4/2002 Schwartz
6,409,871 B1 6/2002 Washburn et al.
6,438,881 B1 8/2002 Riley
6,510,634 B1 1/2003 Riley
6,517,921 B2 2/2003 Ulrich et al.
D473,264 S 4/2003 Sanford et al.
6,611,962 B2 9/2003 Redwood et al.
6,641,048 B1 11/2003 Schintz et al.
6,685,228 B2 2/2004 Riley
6,748,687 B2 6/2004 Riley
6,782,648 B1 8/2004 Mosher, Jr.
6,807,680 B2 10/2004 Sloot
6,836,215 B1 12/2004 Laurash et al.
6,844,041 B2 1/2005 Squier et al.
D503,197 S 3/2005 Stewart et al.
6,863,311 B2 3/2005 Riley
6,971,200 B2 12/2005 Paul et al.

(56) References Cited

U.S. PATENT DOCUMENTS

| | | | |
|---|---|---|---|
| 6,981,948 | B2 | 1/2006 | Pellegrino et al. |
| 7,017,293 | B2 | 3/2006 | Riley |
| 7,017,294 | B2 | 3/2006 | Riley et al. |
| D521,565 | S | 5/2006 | Stewart et al. |
| 7,047,682 | B2 | 5/2006 | Riley |
| 7,197,842 | B2 | 4/2007 | Ali |
| 7,222,448 | B2 | 5/2007 | Riley |
| 7,240,446 | B2 | 7/2007 | Bekker |
| 7,286,055 | B2 | 10/2007 | Girvin et al. |
| 7,325,347 | B2 | 2/2008 | Riley |
| 7,386,949 | B2 | 6/2008 | Riley |
| 7,454,854 | B2 | 11/2008 | Riley et al. |
| 7,461,473 | B2 | 12/2008 | Riley |
| 7,520,077 | B2 | 4/2009 | Riley |
| 7,523,576 | B1 | 4/2009 | Petty |
| 7,654,024 | B2 | 2/2010 | Riley |
| 7,658,026 | B2 | 2/2010 | Jain et al. |
| 7,658,027 | B2 | 2/2010 | Jain et al. |
| D611,984 | S | 3/2010 | Ali et al. |
| 7,763,344 | B2 | 7/2010 | Riley et al. |
| 7,779,569 | B2 | 8/2010 | Riley et al. |
| 7,779,570 | B2 | 8/2010 | Riley |
| 7,784,209 | B2 | 8/2010 | Greer |
| 7,784,210 | B2 | 8/2010 | Riley et al. |
| 7,818,908 | B2 | 10/2010 | Greer |
| 7,823,310 | B2 | 11/2010 | Jain et al. |
| 7,877,915 | B2 | 2/2011 | Jain et al. |
| 7,883,018 | B2 | 2/2011 | Riley et al. |
| 7,918,045 | B2 | 4/2011 | Riley |
| D640,738 | S | 6/2011 | Jain et al. |
| 7,967,340 | B2 | 6/2011 | Hofer et al. |
| 8,006,422 | B2 | 8/2011 | Riley |
| 8,011,125 | B2 | 9/2011 | Riley et al. |
| 8,042,293 | B1 | 10/2011 | Bennett et al. |
| 8,074,389 | B2 | 12/2011 | Greer et al. |
| 8,099,888 | B2 | 1/2012 | Riley |
| 8,109,021 | B2 | 2/2012 | Jain et al. |
| 8,424,115 | B2 | 4/2013 | Greer |
| 8,776,417 | B2 | 7/2014 | Jain et al. |
| 8,844,972 | B2 | 9/2014 | Riley et al. |
| 8,904,686 | B2 | 12/2014 | Greer |
| 9,114,187 | B2 | 8/2015 | Hofer et al. |
| 10,207,020 | B2 | 2/2019 | Hofer et al. |
| 10,249,221 | B2 | 4/2019 | Davis et al. |
| 10,997,874 | B1 | 5/2021 | Kraft et al. |
| 11,232,719 | B1 | 1/2022 | Kraft et al. |
| 11,238,759 | B1 | 2/2022 | Staudinger et al. |
| 2002/0152928 | A1 | 10/2002 | Lawandy et al. |
| 2002/0176973 | A1 | 11/2002 | Keiser |
| 2003/0001381 | A1 | 1/2003 | Riley |
| 2003/0003249 | A1 | 1/2003 | Benim et al. |
| 2003/0011190 | A1 | 1/2003 | Ryan |
| 2004/0060216 | A1 | 4/2004 | Riley |
| 2004/0068906 | A1 | 4/2004 | Riley et al. |
| 2004/0128892 | A1 | 7/2004 | Paul et al. |
| 2004/0148836 | A1 | 8/2004 | Riley |
| 2004/0244251 | A1 | 12/2004 | Riley |
| 2005/0091896 | A1 | 5/2005 | Kotik et al. |
| 2005/0108912 | A1 | 5/2005 | Bekker |
| 2005/0279001 | A1 | 12/2005 | Riley |
| 2005/0281989 | A1 | 12/2005 | Finger |
| 2006/0113788 | A1 | 6/2006 | Riley |
| 2006/0230661 | A1 | 10/2006 | Bekker |
| 2006/0236578 | A1 | 10/2006 | Saint et al. |
| 2006/0242875 | A1 | 11/2006 | Wilson et al. |
| 2006/0261958 | A1 | 11/2006 | Klein et al. |
| 2007/0089342 | A1 | 4/2007 | Jain et al. |
| 2007/0120358 | A1 | 5/2007 | Waggoner et al. |
| 2007/0243361 | A1 | 10/2007 | Riley et al. |
| 2007/0257113 | A1 | 11/2007 | Davis et al. |
| 2008/0098636 | A1 | 5/2008 | Greer |
| 2008/0156862 | A1* | 7/2008 | Haas ..... B65D 27/06 283/67 |
| 2008/0236011 | A1 | 10/2008 | Bekker |
| 2009/0031602 | A1 | 2/2009 | Riley |
| 2009/0094872 | A1 | 4/2009 | Ali et al. |
| 2009/0094873 | A1 | 4/2009 | Riley |
| 2009/0193701 | A1 | 8/2009 | Greer |
| 2009/0277061 | A1 | 11/2009 | Jain et al. |
| 2009/0282717 | A1 | 11/2009 | Jain et al. |
| 2010/0071241 | A1 | 3/2010 | Jain et al. |
| 2010/0253060 | A1 | 10/2010 | Riley et al. |
| 2010/0281724 | A1 | 11/2010 | Greer et al. |
| 2011/0042933 | A1 | 2/2011 | Landsman et al. |
| 2012/0210620 | A1 | 8/2012 | Jain et al. |
| 2013/0056974 | A1 | 3/2013 | Jain et al. |
| 2016/0335928 | A1 | 11/2016 | Lux |

FOREIGN PATENT DOCUMENTS

| | | | |
|---|---|---|---|
| EP | 1974603 | A2 | 10/2008 |
| EP | 2806594 | A1 | 11/2014 |
| FR | 960859 | A | 4/1950 |
| GB | 561777 | A | 6/1944 |
| GB | 2045718 | A | 11/1980 |
| GB | 2160492 | A | 12/1985 |
| GB | 2228915 | A | 9/1990 |
| JP | H08190350 | A | 7/1996 |
| JP | H08299035 | A | 11/1996 |
| JP | 3032299 | U | 12/1996 |
| JP | H10207374 | A | 8/1998 |
| JP | H1115383 | A | 1/1999 |
| JP | 2001316921 | A | 11/2001 |
| JP | 2002117190 | A | 4/2002 |
| JP | 2002351321 | A | 12/2002 |
| JP | 2003066849 | A | 3/2003 |
| JP | 2003157010 | A | 5/2003 |
| JP | 2003164307 | A | 6/2003 |
| JP | 2006039209 | A | 2/2006 |
| WO | 9612618 | A1 | 5/1996 |
| WO | 9823081 | A1 | 5/1998 |
| WO | 9918817 | A1 | 4/1999 |
| WO | 0239412 | A2 | 5/2002 |
| WO | 03003331 | A2 | 1/2003 |
| WO | 2004028826 | A2 | 4/2004 |
| WO | 2005064574 | A1 | 7/2005 |
| WO | 2006007356 | A1 | 1/2006 |
| WO | 2007021375 | A2 | 2/2007 |
| WO | 2007133906 | A2 | 11/2007 |
| WO | 2008079952 | A2 | 7/2008 |
| WO | 2009099787 | A1 | 8/2009 |
| WO | 2009137195 | A1 | 11/2009 |
| WO | 2010129131 | A1 | 11/2010 |

OTHER PUBLICATIONS

Non-Final Office Action, dated Dec. 29, 2017, 15 pages, issued in U.S. Appl. No. 15/339,105.
Non-Final Office Action, dated Jan. 6, 2021, 8 pages, issued in U.S. Appl. No. 17/013,065.
Notice of Allowance, dated Jan. 11, 2021, 11 pages, issued in U.S. Appl. No. 16/418,723.
Notice of Allowance, dated Oct. 5, 2021, issued in U.S. Appl. No. 17/090,883.
Notice of Allowance, dated Sep. 29, 2021, issued in U.S. Appl. No. 17/013,065.
Non-Final Office Action, dated Jun. 16, 2022, 6 pages, issued in U.S. Appl. No. 16/426,708.
Non-Final Office Action, dated Oct. 30, 2017, 14 pages, issued in U.S. Appl. No. 15/403,922.
Non-Final Office Action, dated Nov. 25, 2022, 8 pages, issued in U.S. Appl. No. 17/659,140.
Non-Final Office Action, dated Oct. 6, 2022, 16 pages, issued in U.S. Appl. No. 17/588,405.
Notice of Allowance, dated Oct. 19, 2022, 8 pages, issued in U.S. Appl. No. 16/426,708.
Notice of Allowance, dated Sep. 2, 2022, 9 pages, issued in U.S. Appl. No. 17/514,620.

* cited by examiner

COMBINATION WRISTBAND AND LABEL FORM

RELATED APPLICATIONS

This application is continuation of U.S. patent application Ser. No. 16/418,723, filed May 21, 2019, which will issue as U.S. Pat. No. 10,997,874, which is a continuation-in-part of, and claims priority to, U.S. patent application Ser. No. 15/403,922, filed Jan. 11, 2017, which granted as U.S. Pat. No. 10,297,170, and which is a continuation of, and claims priority to, U.S. patent application Ser. No. 15/339,105, filed Oct. 31, 2016, which granted as U.S. Pat. No. 10,249,221. The '105 application claims priority to U.S. Provisional Application No. 62/247,863, filed on Oct. 29, 2015, U.S. Provisional Application No. 62/256,465, filed on Nov. 17, 2015, and U.S. Provisional Patent Application No. 62/257,086, filed on Nov. 18, 2015. The disclosures of each of these applications are incorporated by reference in their entireties herein.

BACKGROUND

The wristband is a frequently-used instrument for distinguishing among various groups of people. For example, wristbands may be used to identify persons in short term healthcare facilities, or to distinguish between levels of access (e.g., at a concert) or permissions. Prior art wristbands often have disadvantages. For example, some wristbands include a paper layer which is not water resistant causing the wristband to become torn and tattered. Other designs include wristbands that are removed from a form such that when the wristband is removed, the form is left with a large void which prevents or makes it difficult to pass the form back through a printer. Thus, there is a need for improved wristbands.

SUMMARY

The following presents a simplified summary of the invention in order to provide a basic understanding of some aspects of the invention. This summary is not an extensive overview of the invention. It is not intended to identify critical elements of the invention or to limit the scope of the invention. Its sole purpose is to present some concepts of the invention in a simplified form as a prelude to the more detailed description presented below.

According to an embodiment, a combination wristband and label form has a front sheet which includes a top portion having a plurality of labels die cut therein; and a bottom portion having a wristband die cut therein. At least a portion of the wristband is configured to receive indicia. The bottom portion further includes a peripheral section. The form additionally includes a backing sheet comprising a release liner. The wristband has a central portion which has a centerline therethrough which separates the central portion into an upper section and a lower section. A first arm portion extends from the upper section in a first direction and a second arm portion extends from the lower section in a second opposing direction. The first and second arm portions have first and second lateral ends, respectively, and the lateral ends each have a respective adhesive area with adhesive attached thereto. Removal of the wristband from the form exposes an area of the release liner which is devoid of any voids. The wristband is formed of a single-ply of water-resistant material.

According to an embodiment, a combination wristband and label form, has a front sheet having a top portion having a plurality of labels die cut therein; and a bottom portion having a wristband die cut therein. At least a portion of the wristband is configured to receive indicia. The bottom portion further comprising a peripheral section. The form further includes a backing sheet having a release liner. The wristband comprises a central portion having a centerline therethrough, separating the central portion into an upper generally transparent section and a lower generally opaque section, and first and second arm portions. The first arm portion extends from the upper section in a first direction and the second arm portion extends from the lower section in a second opposing direction. The first and second arm portions have first and second lateral ends, respectively, each having a respective adhesive area with adhesive attached thereto. The wristband is formed of a single-ply of water-resistant material and is configured for removal from the backing sheet in a single continuous motion. Removal of the wristband from the form exposes an area of the release liner which is devoid of any voids.

According to an embodiment, a combination wristband and label form has a front sheet; and a backing sheet having a release liner. The front sheet includes a top portion having a plurality of labels die cut therein; and a bottom portion having a wristband die cut therein, at least a portion of the wristband being configured to receive indicia. The bottom portion further includes a peripheral section permanently adhered to the backing sheet. The wristband has a central portion having a centerline therethrough, separating the central portion into an upper, generally transparent section and a lower, generally opaque section. A first arm portion extends from the upper section in a first direction and a second arm portion extends from the lower section in a second opposing direction. The first and second arm portions have first and second lateral ends, respectively, the first and second lateral ends each having a respective adhesive area with adhesive attached thereto, and at least one of the first and second lateral ends has tamper evident slits. The upper, generally transparent section is configured to receive laser printed indicia. Additionally, the wristband is formed of a single-ply of water-resistant material and is configured for removal from the backing sheet in a single continuous motion. Removal of the wristband from the form exposes an area of the release liner which is devoid of any voids. Accordingly, upon removal of the wristband, the form is configured for multiple passes through a printer.

According to an embodiment, a combination wristband and label form has a front sheet with a bottom portion having a plurality of labels die cut therein, and a top portion having an indicia-receiving area defined therein. A back sheet of the form has a bottom portion having a release liner, and a top portion having a wristband die cut therein and separable therefrom. The wristband includes first and second arm portions extending in opposite directions from a central portion having a top half and a bottom half. The first and second arm portions have first and second lateral ends with respective adhesive areas adjacent thereto. The indicia-receiving area is adjacent an innermost region of the top half of the central portion, a perimeter being defined between an edge defining the top half of the central portion and the indicia-receiving area. Adhesive is provided adjacent the top half of the central portion at the perimeter, there being no adhesive adjacent the indicia-receiving area. Further, adhesive is provided adjacent the bottom half of the central portion, the adhesive substantially covering the entirety of the bottom half of the central portion.

According to an embodiment, a combination wristband and label form includes a front sheet having a bottom portion having a plurality of labels die cut therein, and a top portion having a paper indicia-receiving area die cut therein and separable therefrom. A back sheet of the form has a bottom portion having a release liner, and a top portion having a wristband die cut therein and separable therefrom. The wristband has first and second arm portions extending in opposite directions from a central portion, and the central portion has a centerline therethrough defining a top half and a bottom half. The first arm portion extends from the top half of the central portion and the second arm portion extends from the bottom half of the central portion. The first and second arm portions have first and second lateral ends, respectively, and the first and second lateral ends have respective adhesive areas adjacent thereto, there being no adhesive on the first and second arm portions inward of the respective lateral ends. The paper indicia-receiving area is adjacent an innermost region of the top half of the central portion, and a perimeter is defined between an edge defining the top half of the central portion and the indicia-receiving area. Adhesive is provided adjacent the top half of the central portion at the perimeter, there being no adhesive adjacent the indicia-receiving area, and adhesive is further provided adjacent the bottom half of the central portion, the adhesive substantially covering the entirety of the bottom half of the central portion. The paper indicia-receiving area is adhered to and forms a part of the top half of the central portion. Removal of the wristband from the form exposes an area of a release liner on a back side of the front sheet top portion and a void in the front sheet corresponding to the paper indicia-receiving area, there being no further voids in the form.

According to an embodiment, a combination wristband and label form has a front sheet with a bottom portion having a plurality of labels die cut therein, and a top portion having a void defined therein. A back sheet of the form has a bottom portion having a release liner, and a top portion having a wristband die cut therein and separable therefrom. The wristband includes first and second arm portions extending in opposite directions from a central portion, and the central portion having a centerline therethrough defining a top half and a bottom half. The first arm portion extends from the top half of the central portion and the second arm portion extends from the bottom half of the central portion. The first and second arm portions have first and second lateral ends, respectively, with the first and second lateral ends having respective adhesive areas adjacent thereto. There is no adhesive on the first and second arm portions inward of the respective lateral ends. The void in the front sheet top portion exposes a section of the wristband, and an opaque substance is applied to the exposed section of the wristband to form an indicia-receiving area. A perimeter is defined between an edge defining the top half of the central portion and the indicia-receiving area, and adhesive is provided adjacent the top half of the central portion at the perimeter, there being no adhesive adjacent the indicia-receiving area. Adhesive is also provided adjacent the bottom half of the central portion, the adhesive substantially covering the entirety of the bottom half of the central portion.

According to an embodiment, a combination wristband and label form comprises a front sheet having a label area and a wristband area. The label area comprises a plurality of labels and the wristband area includes a void extending therethrough. The form includes a back sheet opposite the front sheet. The back sheet comprises a label section and a wristband section. The label section corresponds to the label area. The form includes a wristband formed by die cuts in the wristband section. The wristband includes a first strap, a second strap, and a central area. The first strap and the second strap each extend laterally away from the central area. Each of the first strap and the second strap comprise adhesive only on an outer edge thereof. The central area has a printable portion and a laminating portion foldable over the printable portion to laminate at least a part of the printable portion. The printable portion is coated with an ink configured to receive indicia. The ink faces away from the back sheet and is accessible from the front sheet such that the printable portion is configured to be printed by a printer through the void.

According to another embodiment, a combination wristband and label form includes a front sheet comprising paper. The front sheet has a label area and a wristband area. The wristband area is adjacent the label area and has a void extending therethrough. The form includes a back sheet opposing the front sheet. The back sheet has a label section and a wristband section. The label section corresponds to the label area and comprises a plurality of labels die cut therein. The wristband section corresponds to the wristband area. The form includes a wristband defined in the wristband section by die cuts. The wristband is configured to be removable and comprises a printable portion and a laminating portion adjacent the printable portion. The printable portion is coated with a printable substance and is devoid of paper. The printable substance faces away from the back sheet and is accessible through the void such that indicia is configured to be printed on the printable portion through the void while the wristband is attached to the combination wristband and label form.

According to yet another embodiment, a combination wristband and label form comprises a front sheet including paper. The front sheet has a label area and a wristband area. The wristband area is adjacent the label area and comprises a void extending therethrough. The form includes a back sheet opposing the front sheet. The back sheet has a label section and a wristband section. The label section corresponds to the label area and comprises a plurality of labels die cut therein. The wristband section corresponds to the wristband area. A wristband is defined in the wristband section by die cuts. The wristband is configured to be removable and comprises a first strap, a second strap, a printable portion, and a laminating portion adjacent the printable portion. The printable portion is coated with a printable substance and is devoid of paper. The printable substance faces away from the back sheet and is accessible through the void such that indicia is configured to be printed on the printable portion through the void while the wristband is attached to the combination wristband and label form. Each of the first strap and the second strap contains adhesive only on an end thereof.

DETAILED DESCRIPTION

Many wristband designs require multiple steps in order to remove the wristband from its liner and subsequently affix it to the wearer. For example, the user may be required to remove the liner in order to expose adhesive. Other wristbands may be configured to include two layers of material, fastened together with adhesive. The wristband is thus thicker and heavier. Still further designs include a paper layer which is not water resistant that tends to get torn and tattered. According to these designs, a wristband portion is permanently adhered to a paper backing sheet which is die cut in a form, to form a two-layer wristband.

One embodiment of the present invention, described in detail herein, provides for a wristband which may be removed from a form via one generally continuous motion. The wristband may have adhesive on one end only, or on both ends. Further, the wristband may be configured to include only a single layer of a light, synthetic (or other similar) material, thus making the wristband approximately half of the thickness of traditional wristbands currently on the market. Finally, the synthetic material may be water and tear resistant such that the wristband will not tear when removed from the backing sheet prior to affixing the wristband to the person. In one embodiment, the wristband may be configured to be removed from a form without leaving a hole in the form, thus leaving the backing sheet intact such that the form may be passed through a printer multiple times.

Figure 1:
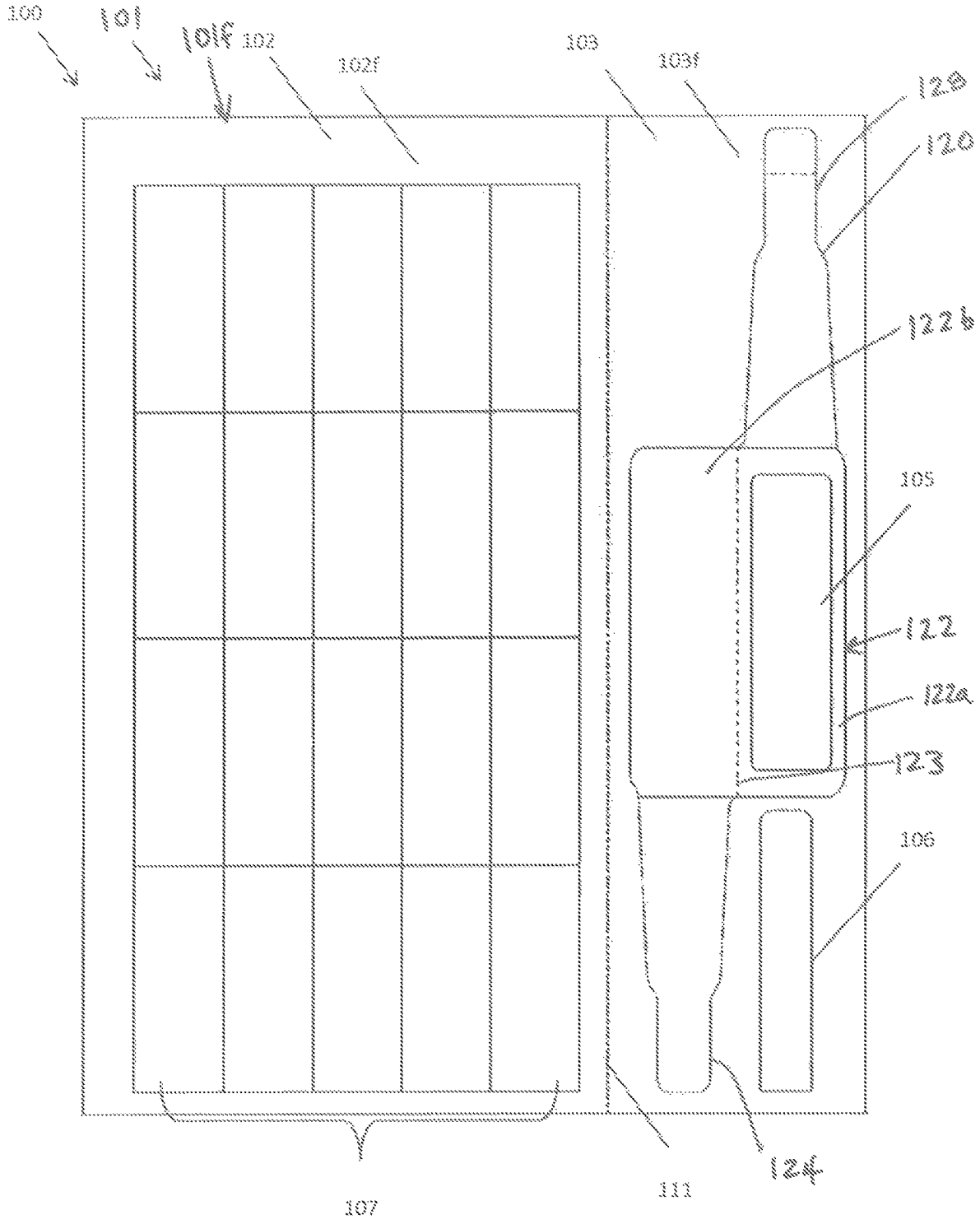
FIG. 1 is a front side view of a combination wristband and label form according to one embodiment of the invention.
Figure 3:
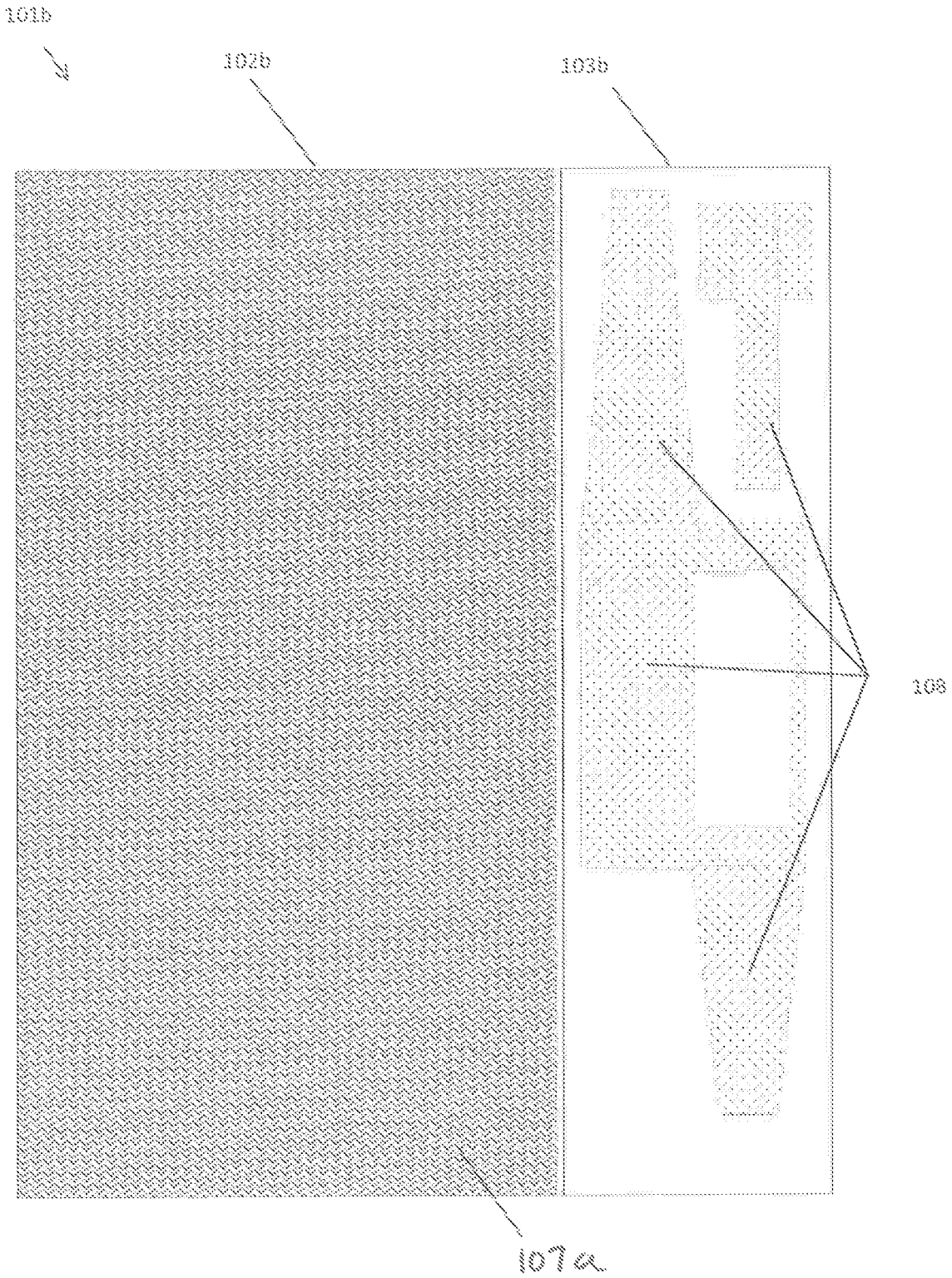
FIG. 3 is a back side view of the combination wristband and label form showing an adhesive and silicone pattern according to the embodiment of FIG. 1.
Figure 4:
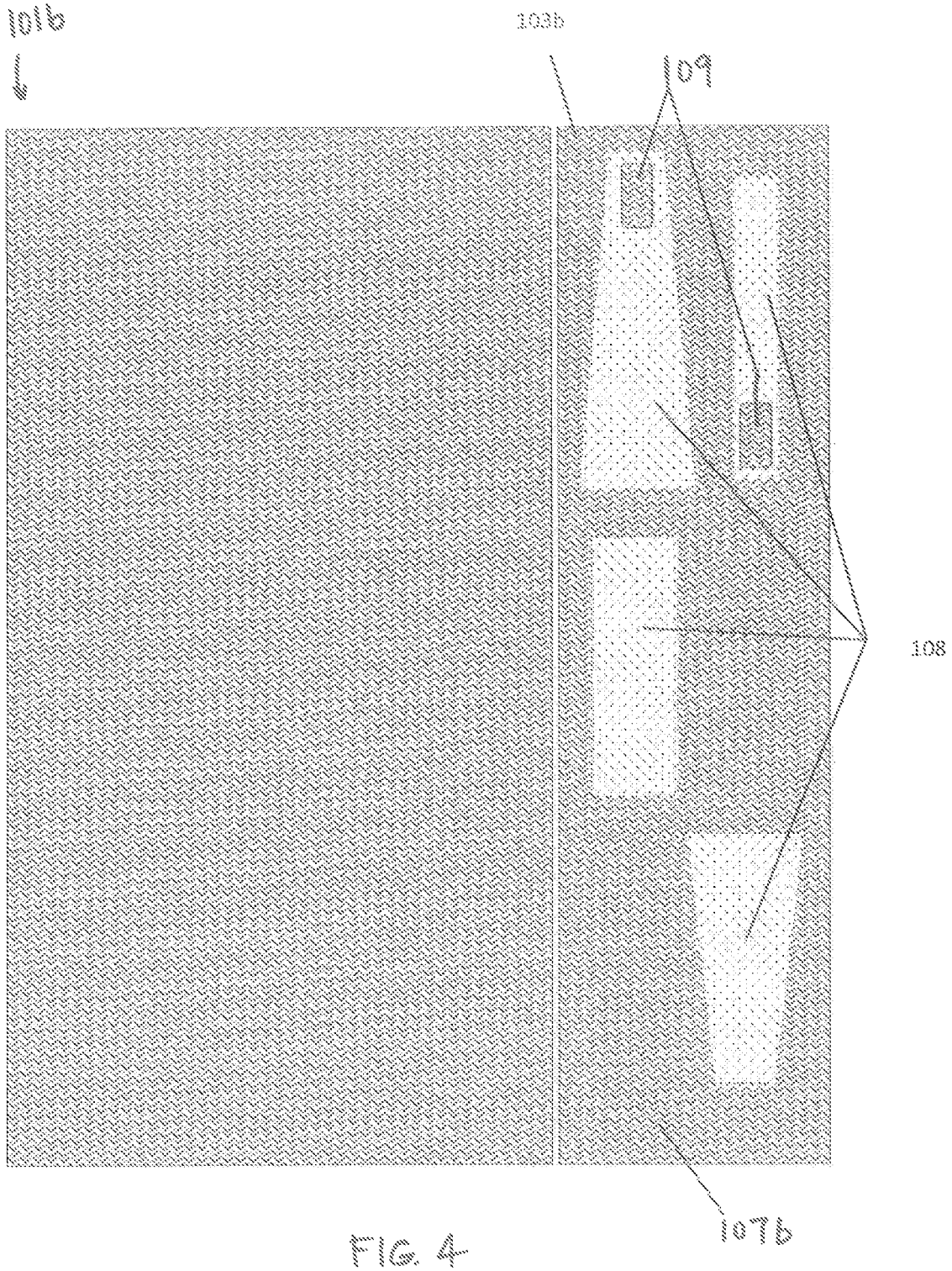
FIG. 4 is a back side view of an alternative embodiment of adhesive and silicone patterns of the form of FIG. 1.

With reference now to the figures, FIG. 1 illustrates one embodiment of a combination wristband and label form 100. The form 100 includes a front sheet 101 adhered to a backing sheet 140. The front sheet 101 has a front side 101*f* and a back side 101*b* (FIGS. 3 and 4). The front sheet 101 may in some embodiments be separated into a top portion 102 and a bottom portion 103 having a relatively small gap therebetween. The top portion 102 and the bottom portion 103 may each have a front face 102*f* and 103*f*, and a back face 102*b* and 103*b*, respectively. The top portion 102 and the bottom portion 103 may be separated by a vertical perforation 111.

The front surface 102*f* of the top portion 102 may include a plurality of labels 107. The labels 107 may be arranged in columns and rows, for example, 4×6. However, the labels 107 may be provided in any combinations of columns (e.g., 1, 2, 3, 4, etc.) and rows (e.g., 1, 2, 3, 4, etc.). The labels 107 may be configured to receive indicia. Accordingly, the front surface 102*f* may be constructed of paper or other appropriate textile sufficient for receiving ink, e.g., from a printer or other marking device.

The labels 107 may have a variety of constructions. For example, the figures illustrate the labels 107 as having a generally rectangular configuration. However, the labels 107 may be square, circular, polygonal, etc. Additionally, a combination of label configurations may be employed on a single form 100.

The bottom portion 103*f* may comprise one or more outlines of wristbands 120. The wristbands 120 may include a paper area 105 which is be configured to be printable. In some embodiments, the form 100 may be configured to be passed through a printer so that indicia (e.g., patient name, patient medications, machine readable information such as barcodes, et cetera) may be printed directly on the wristband paper area 105. The paper area 105 may be die cut into the bottom portion 103*f*. In this manner, the paper area 105 may face the same direction as the labels 107, making it easier for indicia to be simultaneously printed on the labels 107 and the paper area 105.

Attention is now directed to FIGS. 3 and 4, which shows the back side 101*b* of the form 100. The back side 101*b* may include a back face 102*b* of the top portion 102 and a back face 103*b* of the bottom portion 103. The back face top portion 102*b* may include an adhesive area 107*a*. The adhesive area 107*a* may allow for the labels 107 to be releasably secured to the backing sheet 140. The back face bottom portion 103*b* may additionally have an adhesive area 107*b*. The adhesive area 107*b* may correspond to the area surrounding the wristband 120 which remains in place when the wristband 120 is removed from the form 100.

Figure 2:
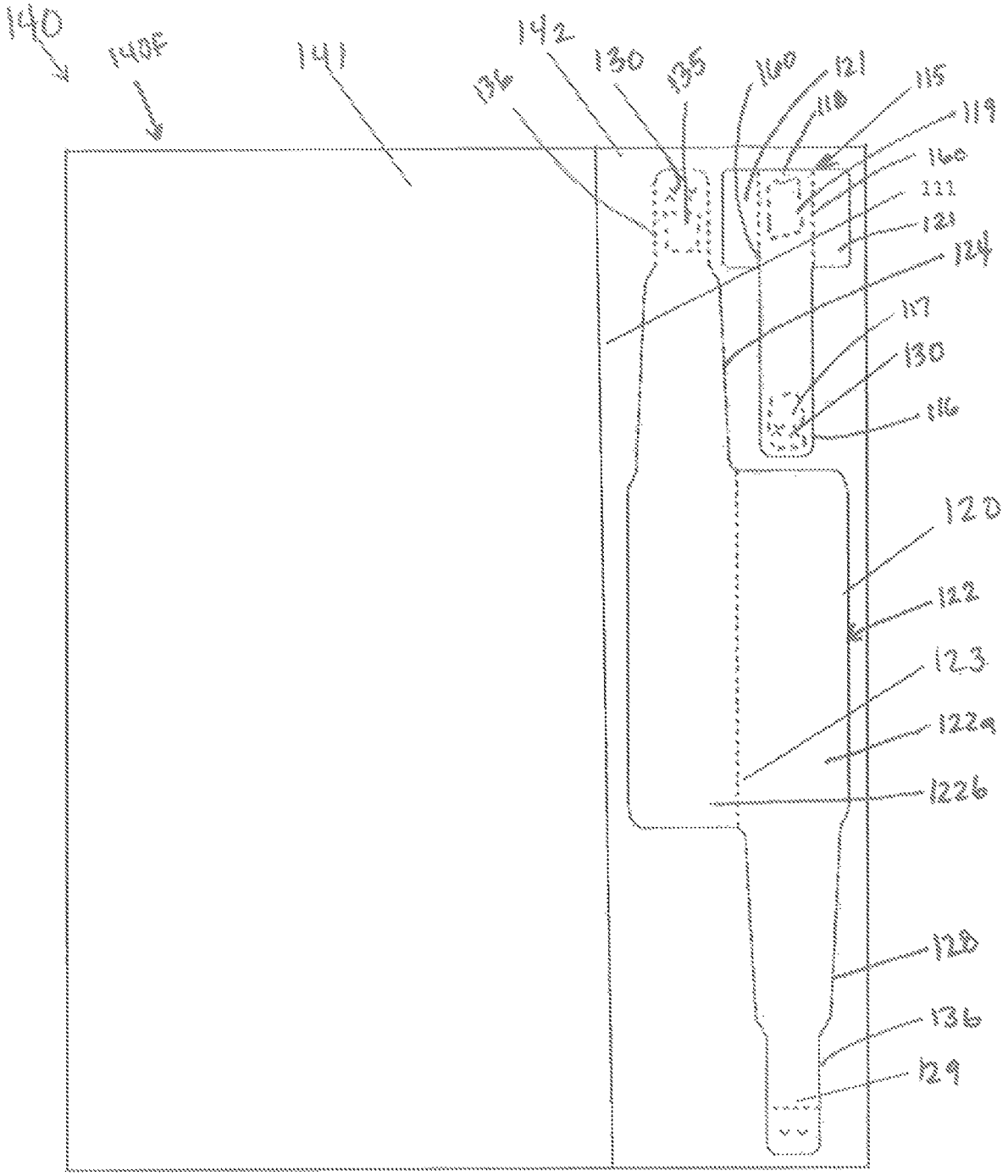
FIG. 2 is a back side view of the combination wristband and label form according to FIG. 1.

The adhesive areas 107*a* and 107*b* of the back faces 102*b* and 103*b* may adhere to a back side of the backing sheet 140, illustrated in FIG. 2. A top portion 141 of the backing sheet 140 may be constructed of paper or a synthetic resin, and the back side of the top portion 141 (not shown) may include a layer of silicone (or another similar release material) in the area corresponding to the adhesive area 107*a*. A back side of the bottom portion 142 of the backing sheet 140 may additionally include a layer of silicone in the area corresponding to adhesive area 107*b*, or may alternatively be permanently adhered to adhesive area 107*b* (such that the bottom portion 142 does not include a silicone layer). For example, the adhesive area 107*a* may releasably adhere to the silicone material on top portion 141, and adhesive area 107*b* may releasably (or permanently) adhere to bottom portion 142 as appropriate. The silicone material may be applied in a pattern which may allow for a more permanent adhesion between the backing sheet 140 and the front sheet 102 in areas void of silicone (e.g., the bond between the area of the bottom portion 142 surrounding the wristband 120 and the back side bottom portion 103*b* may be stronger than the bond between the top portion 102*b* and the top portion 141 of the backing sheet 140). This may keep the area of the bottom portion 142 surrounding the wristband 120 in place upon removal of the wristband 120. In some embodiments, the silicone material 107*b* may be completely omitted so that the area of the bottom portion 142 surrounding the wristband 120 permanently adheres to the back side bottom portion 103*b*.

As shown in FIG. 3, the back side bottom portion 103*b* may further include areas of silicone 108 which may coincide with the wristband 120. Additionally, as illustrated in FIG. 4, areas of adhesive 109 may be provided on the areas of silicone 108 to adhere the wristband 120 in place. Alternatively, as described below, adhesive 117, 119, and 135 may be applied to a back side of the backing 142 corresponding to portions of the wristband 120 and/or extension portion 115 in order to adhere the ends 124 and 128 of the wristband 120 together.

FIG. 2 illustrates the backing sheet 140 having a top portion 141 and a bottom portion 142. The wristband 120 may be die cut into the bottom portion 142 of the backing sheet 140, and may be defined by two laterally opposing sides (or ends) 124 and 128 which may extend directly (e.g., without a transition) from a central portion 122 having an upper portion 122*a* and a lower portion 122*b* separated by an indention 123. The laterally opposing sides (or ends) 124 and 128 may extend from the lower portion 122*b* and the upper portion 122*a*, respectively (or vice versa).

The sides 124 and 128 extend directly from a central portion 122, without any transition, such as a shoulder, or other type of transition. With such a configuration, the material required for the wristband 120 may be less than otherwise may be required. Further, the design is sleek, having no protrusions or other unneeded and/or unwanted areas of material extending from the central portion 122 and/or the sides 124 and 128.

As noted above, the upper portion 122*a* (or the lower portion 122*b*) of the central portion 122 may include a small paper area 205 that is removed from the front sheet 101 along with the wristband 120. The small paper area 105 may leave a small hole in the form 100 after removal therefrom. The wristband 120 may be configured to be self-laminating to protect the paper area 105. Accordingly, adhesive may be applied to surround the paper area 105 on the central upper portion 122*a*. Upon removal of the wristband 120 from the form 100, the wristband 120 may be folded about the indention 123 such that the adhesive on the central upper portion 122*a* adheres to the central lower portion 122*b* so that the paper area 105 is secured therebetween. Optionally, adhesive may be applied to the backside of the central lower portion 122*b* in addition to, or instead of adhesive applied to the backside of the central upper portion 122*a*.

One of the laterally opposed sides, e.g., side 128, may include perforations 129, and have no adhesive inwardly adjacent the perforations 129. The other laterally opposed side, e.g., side 124, may contain an area of adhesive 135 (FIG. 2) on a backside of the wristband 120, which may be in addition to the adhesive 109 provided on the face sheet portion back side 103*b*. Alternatively, the adhesive at side 124 may be provided instead of the adhesive 109. The adhesive 135 and/or 109 may keep the end 124 secured to the front sheet back side bottom portion 103*b*. The wristband 120 may be substantially held into position via the adhesive patch 135 and the perforated side 128. The wristband 120 may contain no adhesive apart from the adhesive 135 adjacent the end 124 and the adhesive surrounding the paper area 105 as described above.

The laterally opposing sides 124 and 128 of the wristband 120 may be generally rectangular. In one embodiment, the sides 124 and 128 are completely straight, without a taper. Alternatively, as shown in the figures, the sides 124 and 128 may gradually taper towards the end and may conclude in a tongue 136. Alternatively, the wristband 120 may take on other desirable shapes. In one embodiment, a height of the tongue 136 (e.g., end 124) may be less than a height of the remainder of the wristband 120 (including being less than the height of the end 128).

The wristband 120 may be further equipped with security slits 130. The security slits 130 may be configured to tear, should the wristband 120 be tampered with after the wristband 120 is applied to a wearer. This may be beneficial to ensure that the wristband 120 remains associated with the intended wearer, particularly in a healthcare environment where the wristband 120 includes patient-specific information.

In addition to the wristband 120, an extension portion 115 may be die cut into the bottom portion 142 of the backing sheet 140 to allow the wristband 120 to accommodate larger wrists. The extension portion 115 may include a first end 116 having an area of adhesive 117 on the backside thereof. A second end 118 may additionally have an area of adhesive 119 on the backside. Adhesive may not be located between the first and second ends of the extension portion 116 and 118, respectively. The second end 118 may additionally include arms 121 extending outwardly from the second end 118, and separated from the second end 118 by lines of perforation 160. Adhesive may be located on the backside of the arms 121. In one embodiment, the arms 121 may be separated from the second end 118 by tearing away at the lines of perforation 160. In another embodiment, the extension second end 118 may be aligned with an end 124 or 128 of the wristband 120 and placed thereupon. The arms 121 may then be folded about the lines of perforation 160, one at a time, to further secured the extension 115 to the wristband 120.

As noted above, the extension portion 115 may attach to either end 124 and 128 of the wristband 120, and may extend the reach of the band 120 by approximately one and one-half inches, for example, although other lengths may additionally or alternatively be accommodated. Further, the extension may also incorporate tamper evident slits 130.

The bottom portion 142 may be constructed of a synthetic material, such as polyester fabric or plastic, for example. Other materials may additionally, or alternately, be appropriate. Those of skill in the art may recognize that it may be beneficial for the wristband 120 material to be resistant to water or other liquid, which may cause the integrity of the wristband 120 to be prematurely compromised.

In use, after the wristband 120 has been printed, the user may peel the side 124 of the wristband 120 up and away from the form 100, inserting his or her finger under, for example, the bottom edge, until the finger exits at the top edge. The user may then tear the side 128 along the perforations 129 to free the wristband 120 from the form 100. Alternately, the user may hold the wristband 100, e.g., from the top or bottom edge, between his index finger and thumb, tear the side 128 along the perforations 129, and then separate the wristband 120, including the side 124 having the adhesive 119, from the form 100. In this way, the user may remove the wristband 120 from the form 100 in one generally continuous motion. The user may then fold the wristband 120 about the indention 123 and subsequently attach the wristband 120 to a person's wrist by wrapping the wristband 120 around the wrist, face up, and fastening the adhesive end (e.g., side 124) to the face of the wristband 120. The extension portion 115 may similarly be removed from the form 100 and secured to the wristband 120 as described above.

Such quick and convenient removal of the wristband 120 and/or the extension portion 115 from a single side (e.g., of the backing sheet 140) of the form 100 and its ready securement to a person's wrist may be preferable, as compared for example, to wristbands that must be removed from the associated forms in several steps. This may allow the user to save valuable time, especially where many wristbands 120 are utilized in a single setting. Further, the wristband 120 being removed from a single side of the form 100 eliminates the difficulty of the user having to access both sides of the form 100 in order to push one piece through in order to pull the remainder of the wristband off the form.

Figure 5:
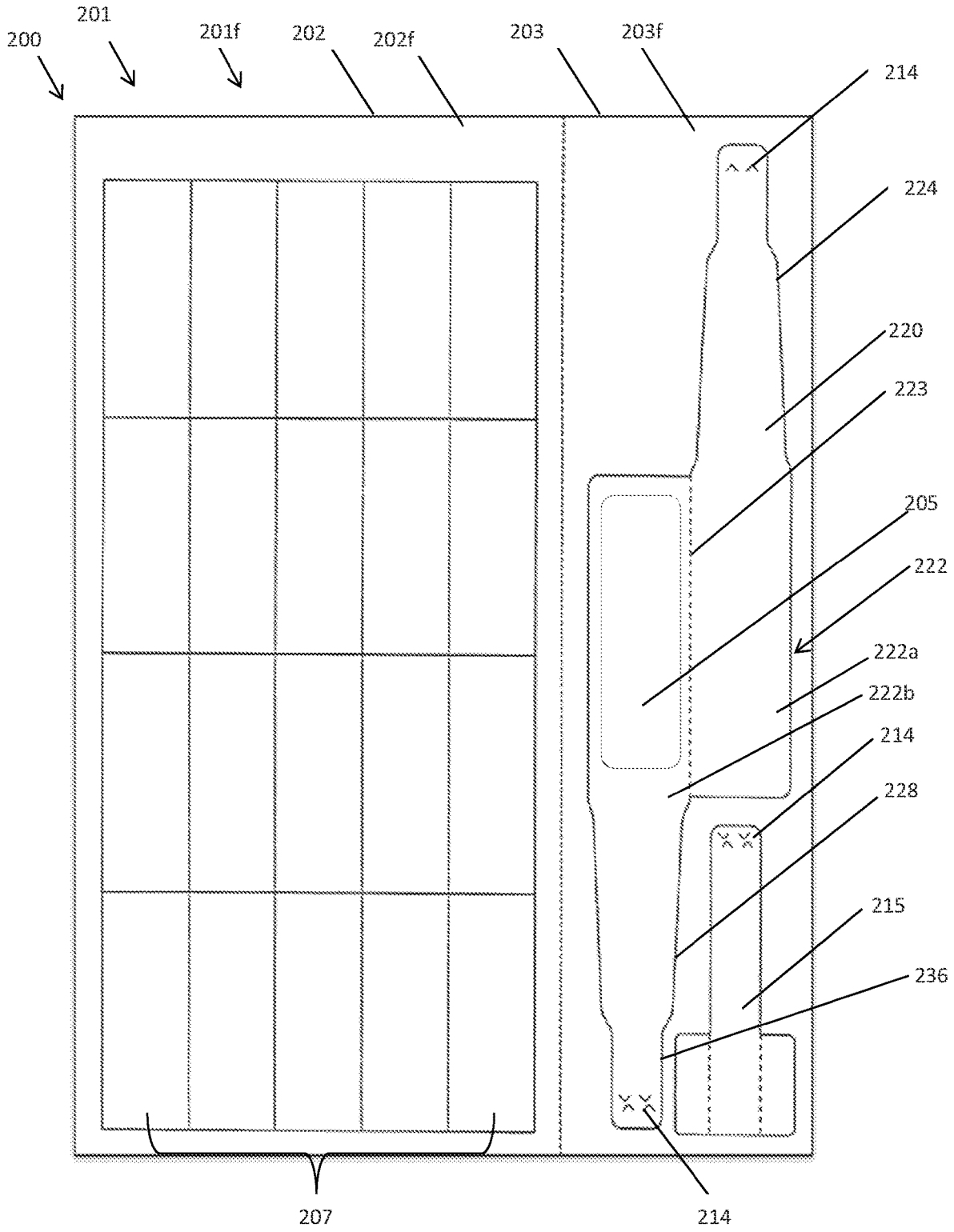
FIG. 5 is a front side view of a combination wristband and label form according to another embodiment of the invention.
Figure 6:
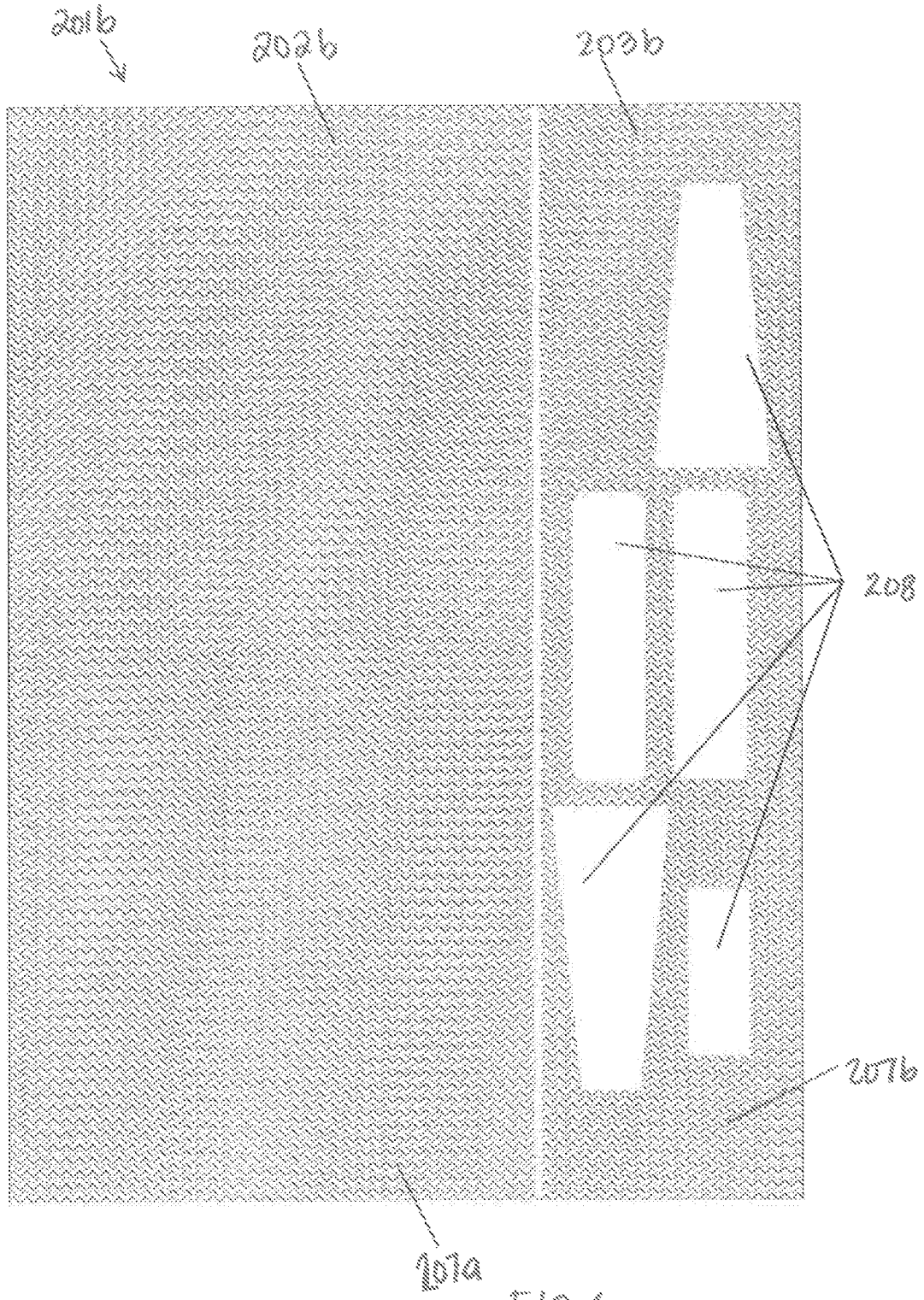
FIG. 6 is a back side view of the combination wristband and label form of FIG. 5.
Figure 7:
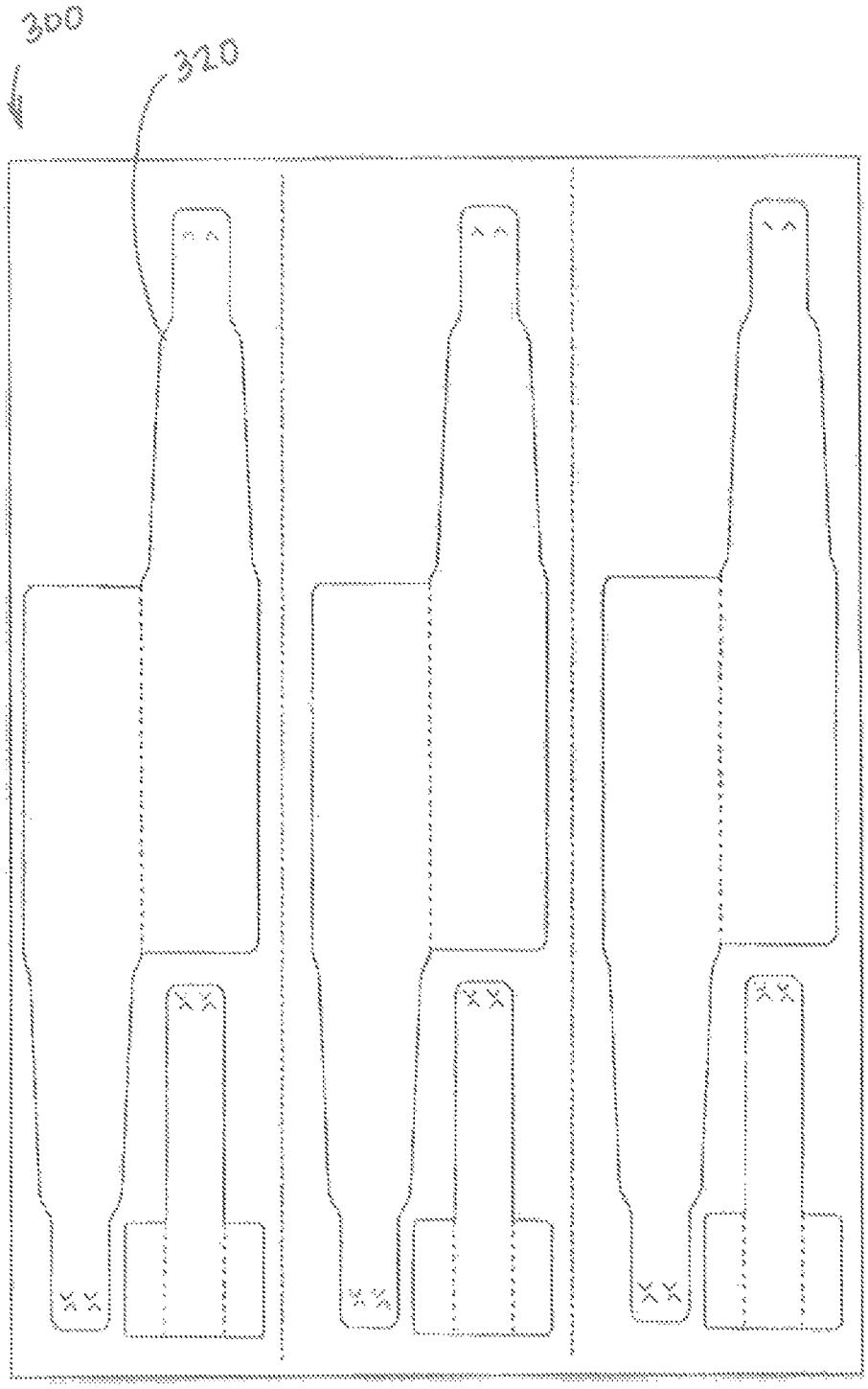
FIG. 7 is a front side view of an alternative embodiment of the form of FIG. 5.

Referring now to FIGS. 5-7, an alternative embodiment of a wristband 220 is illustrated which is similar to the wristband 120 except as shown and described herein. Here, the wristband 220 may be die cut into the bottom portion front face 203*f*, and may be defined by two laterally opposing sides (or ends) 224 and 228 which may extend directly (e.g., without a transition) from a central portion 222 having an upper portion 222*a* and a lower portion 222*b* separated by an indention 223. The laterally opposing sides (or ends) 124 and 128 may extend outwardly from the lower portion 222*b* and the upper portion 222*a*, respectively (or from the upper portion 222*a* and the lower portion 222*b*, respectively).

The sides 224 and 228 may be generally rectangular, and may be completely straight. Optionally, the sides 224 and 228 may taper aware from the central portion 222 and conclude in a tongue 226, similar to the wristband 120 described above. One or both ends 224 and 228 may include tamper evident slits 214, configured to tear should the wristband 220 be tampered with after the wristband 220 is applied to the wearer.

The lower portion 222*b* (or the upper portion 222*a* as the case may be) of the central portion 222 may include a small laser printable area 205 which may allow indicia to be printed on the wristband 220 without having to provide a paper area. Further, the laser printable area may allow for the wristband 220 to be removed from the form 200 without leaving a hole in the form 200.

An extension band 215, substantially similar to extension band 115 may additionally be included with the wristband 220 on the front face bottom portion 203*b*.

Referring now to FIG. 6, which illustrates a back side 201*b* of the form 200, adhesive areas 207*a* and 207*b* may be provided. It may be advantageous to additionally have areas 208 without adhesive. The adhesive areas 207*a* and 207*b* may adhere to a backing sheet which may be made of, for example, paper or synthetic resin and may be generally similar to back sheet 140. The backing sheet may include silicone or other suitable release material on the side of the backing sheet which contacts the adhesive areas 207*a* and 207*b*. This may thus allow the top portion 202 and bottom portion 203 to be releasably adhered to the backing sheet. As can be seen my comparing FIGS. 5 and 6, the area of adhesive 207*b* may be such that it encompasses a portion of the sides 224 and 228, and further such that adhesive is provided around the perimeter(s) of the central upper and lower portions 222*a* and 222*b*.

The configuration of the wristband 220 on the form 200 may be such that the adhesive ends 224 and 228 are initially all facing the same direction (e.g., toward the backing sheet). Upon folding the wristband 220 about the indention 223, the adhesive covered ends 224 and 228 may face in opposite directions such that they meet back to back, thus forming a solid adhesion to the wristband 220 (or the extension portion 215) and not exposing the adhesive to the patient.

In use, a user may peel the wristband 220 from the form 200, wherein the adhesive remains at the desired location on the underside of the wristband. The wristband 220 may be peeled from the form 200 in a similar manner as that described above regarding wristband 120. Specifically, a user may insert his or her finger under the wristband 220 from the bottom edge, the finger exiting under the top edge. The user may then slide his or her finger toward one of the ends (e.g., end 228) to release the adhesive under the end 228 from the backing. The user may then grasp the end (e.g., 228) and peel the rest of the wristband 220 from the backing. Therefore, as with the wristband 120, the wristband 220 may similarly be pulled from a single side of the form 200.

When the wristband 220 is removed from the form 200, the area of the backing sheet behind the wristband 120 may remain intact. Such a configuration may provide several benefits over prior art wristbands. For example, as noted above, other methods may consist of "punching out" the wristband from the form leaves a void that may prevent the rest of the form from being used at a later time. However, if the form remains intact, as in the present invention, it may be used multiple times, for example, to print on the labels 207. This may be beneficial because it is often desirable to print the labels 207 at different times (for example, it may be desirable to print new labels 207 to reflect changes made to medications prescribed to a patient during the course of his treatment). A new label 207, such as a label 207 leftover on the form 200, may thus be printed with the new information until all the labels 207 have been used. Of course, the labels 207 may be used for any desirable purposes, such as for labeling patient files and other documents, vials, etc. The labels 207 may all be printed with information in a single pass through the printer, or the form 200 may be passed through the printer multiple times such that the labels 207 are printed as needed.

In another embodiment, illustrated in FIG. 7, a form 300 may consist of a plurality of wristbands 320 (which may be wristband 120, 220, or another alternative wristband) and does not include labels 107 and 207. Alternately, a form may include only a single wristband. The form 300 may be approximately the size of a standard piece of paper (e.g., 8½"×11"), or the form may be tailored to the size of the required wristbands and/or labels. For example, if only a single wristband is required, the form may be only the size necessary to contain one wristband.

Figure 8:
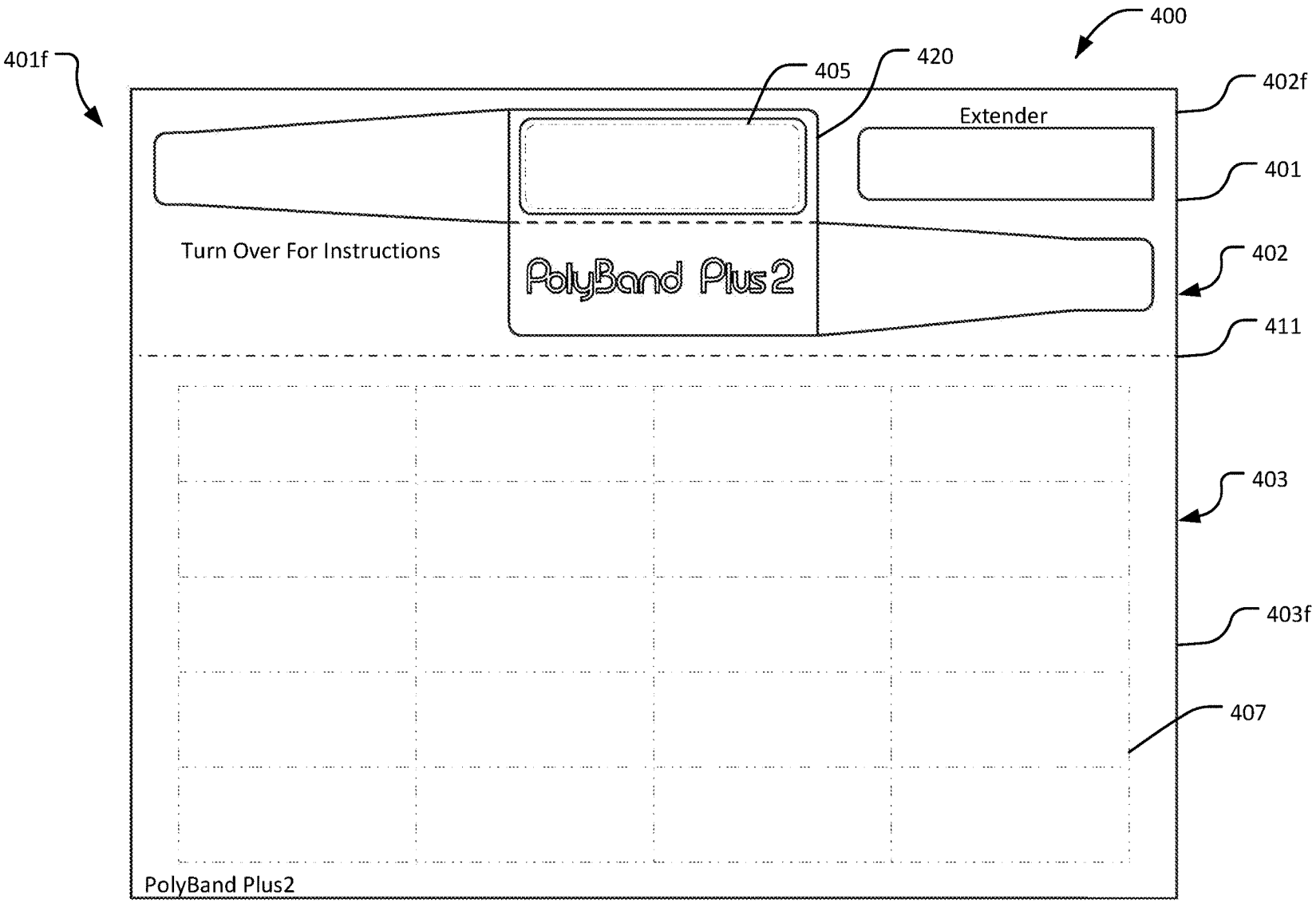
FIG. 8 is a front view of a front side of a combination wristband and label form according to another embodiment of the invention.
Figure 9:
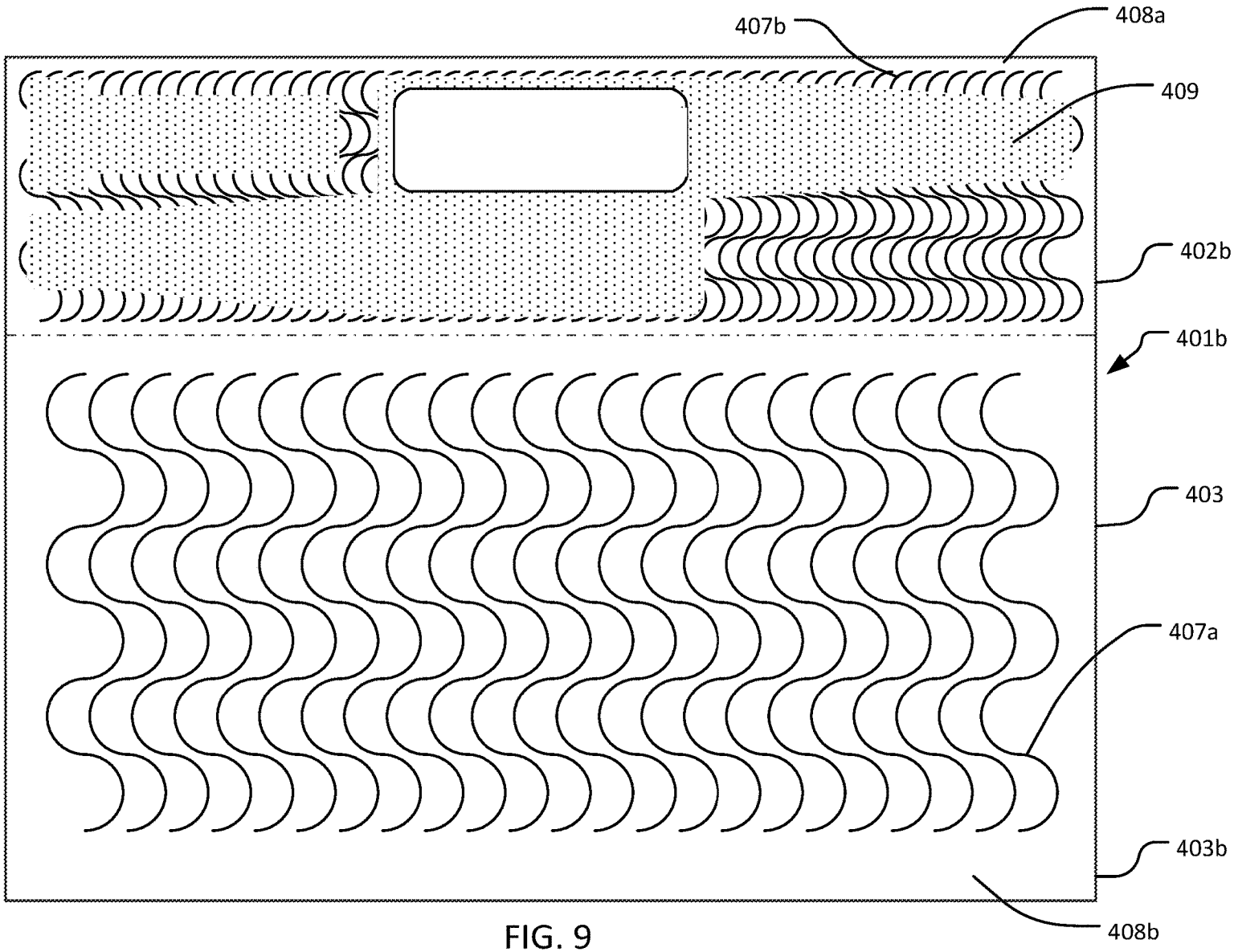
FIG. 9 is a back view of the front side of the combination wristband and label form of FIG. 8.

Moving on, FIGS. 8-11 illustrate yet another embodiment of a combination wristband and label form 400. The form 400 includes a front sheet 401 adhered to a back sheet 440. The front sheet 401 has a front side 401*f* and a back side 401*b* (FIGS. 8 and 9, respectively). The front sheet 401 may in some embodiments be separated into a top portion 402 and a bottom portion 403 having a relatively small gap therebetween. The top portion 402 and the bottom portion 403 may thus each have a front face 402*f* and 403*f*, and a back face 402*b* and 403*b*, respectively. The top portion 402 and the bottom portion 403 may be separated by a perforation 411.

The front face 403*f* of the bottom portion 403 may include a plurality of labels 407. As noted above, the labels 407 may be arranged in columns and rows, for example, 4×6. However, the labels 407 may be provided in any number of combinations of columns (e.g., 1, 2, 3, 4, etc.) and rows (e.g., 1, 2, 3, 4, etc.). The labels 407 may be configured to receive indicia. Accordingly, the front face 403*f* may be constructed of paper or other appropriate textile sufficient for receiving ink, e.g., from a printer or other marking device.

The labels 407 may have a variety of constructions. For example, the figures illustrate the labels 407 as having a generally rectangular configuration. However, the labels 407 may be square, circular, polygonal, etc. Additionally, a combination of label configurations may be employed on a single form 400.

The front face 402*f* of the top portion 402 may comprise one or more outlines of a wristband 420. An indicia-receiving area 405 may be defined within the outline 420, and may be die cut into the top portion. In some embodiments, rather than a die cut indicia-receiving area, a void may be formed into the top portion 402 such that a top portion back side 441*b* of the back sheet 440 (FIG. 11) is accessible through the void. In embodiments, a generally opaque substance (e.g., one or more layers of translucent or opaque ink, paint, or other such coating) configured to receive indicia may be disposed on the top portion back side 441*b* of the back sheet 440 in the area of the void to form the indicia-receiving area 405. In these embodiments, the wristband may be completely devoid of the paper ply traditionally used for the printing of indicia on the wristband. More specifically, wristbands traditionally include a paper area (e.g., paper area 105 in FIG. 1) on which indicia is printed and which paper area is thereafter laminated by a panel of the wristband when the wristband is folded (e.g., along indentation 123 in FIG. 1). In embodiments of the present disclosure, however, the wristband may be devoid of the paper area; indicia may instead be printed directly onto the generally opaque coating (e.g., the generally opaque ink) and laminated thereafter by a wristband panel when the wristband is folded along indentation 423, as discussed herein. In these embodiments, the wristband itself may thus comprise only a single ply (formed, e.g., of polyester, plastic, fabric, and/or other suitable materials). The single-ply wristband may, in applications, be considered more desirable relative to the two-ply wristbands because of the lower manufacturing costs, reduced thickness, et cetera. In other embodiments, the indicia receiving area 405 may comprise paper.

In any event, the indicia-receiving area 405 (both, in embodiments of the wristband comprising a paper area and in embodiments of the wristband devoid of the paper area) may be configured to be printable. In some embodiments, the form 400 may be configured to be passed through a printer so that indicia (e.g., patient name, patient medications, machine readable information such as barcodes, et cetera) may be printed directly on the wristband indicia-receiving area 405. The indicia-receiving area 405 may face the same direction as the labels 407, making it easier for indicia to be simultaneously printed on the labels 407 and the indicia-receiving area 405.

Attention is now directed to FIG. 9, which shows the back side 401*b* of the front sheet 401 of the form 400. The back side 401*b* may include a top portion back face 402*b* and a bottom portion back face 403*b*, which may be separated by a small gap. The bottom portion back face 403*b* may include an adhesive area 407*a*. The adhesive area 407*a* may allow for the labels 407 to be releasably secured to the back sheet 440. In embodiments, a perimeter 408*b* is defined between an outside edge of the bottom portion back face 403*b* and the adhesive area 407*a*. The top portion back face 402*b* may additionally have an adhesive area 407*b*. The adhesive area 407*b* may correspond to the area surrounding the wristband 420 which remains in place when the wristband 420 is removed from the form 400 as is described in greater detail below. Similarly, a perimeter 408*a* may be defined between an outside edge of the top portion back face 402*b* and the adhesive area 407*b*.

Figure 10:
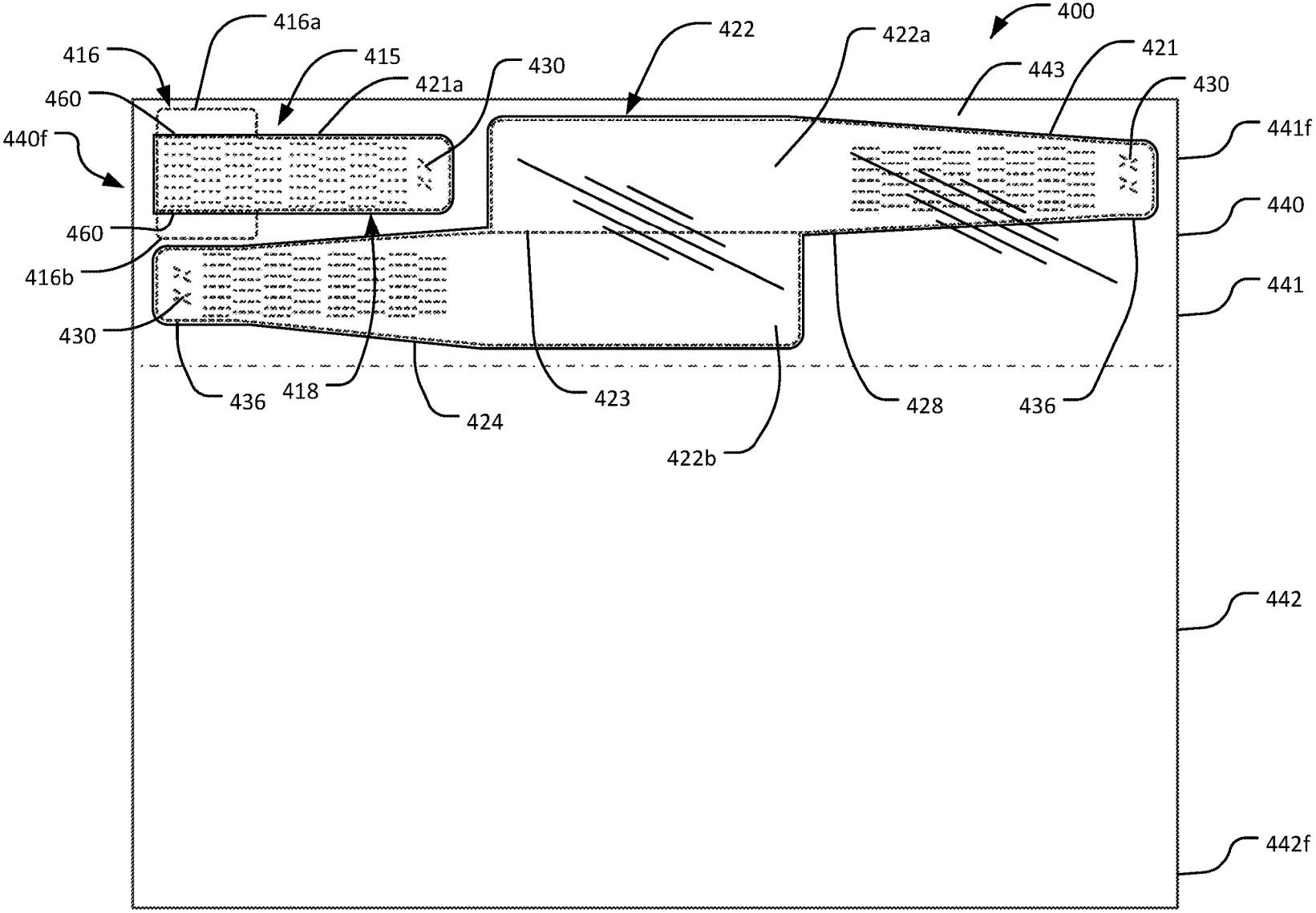
FIG. 10 is a front view of a back side of the combination wristband and label form of FIG. 8.
Figure 11:
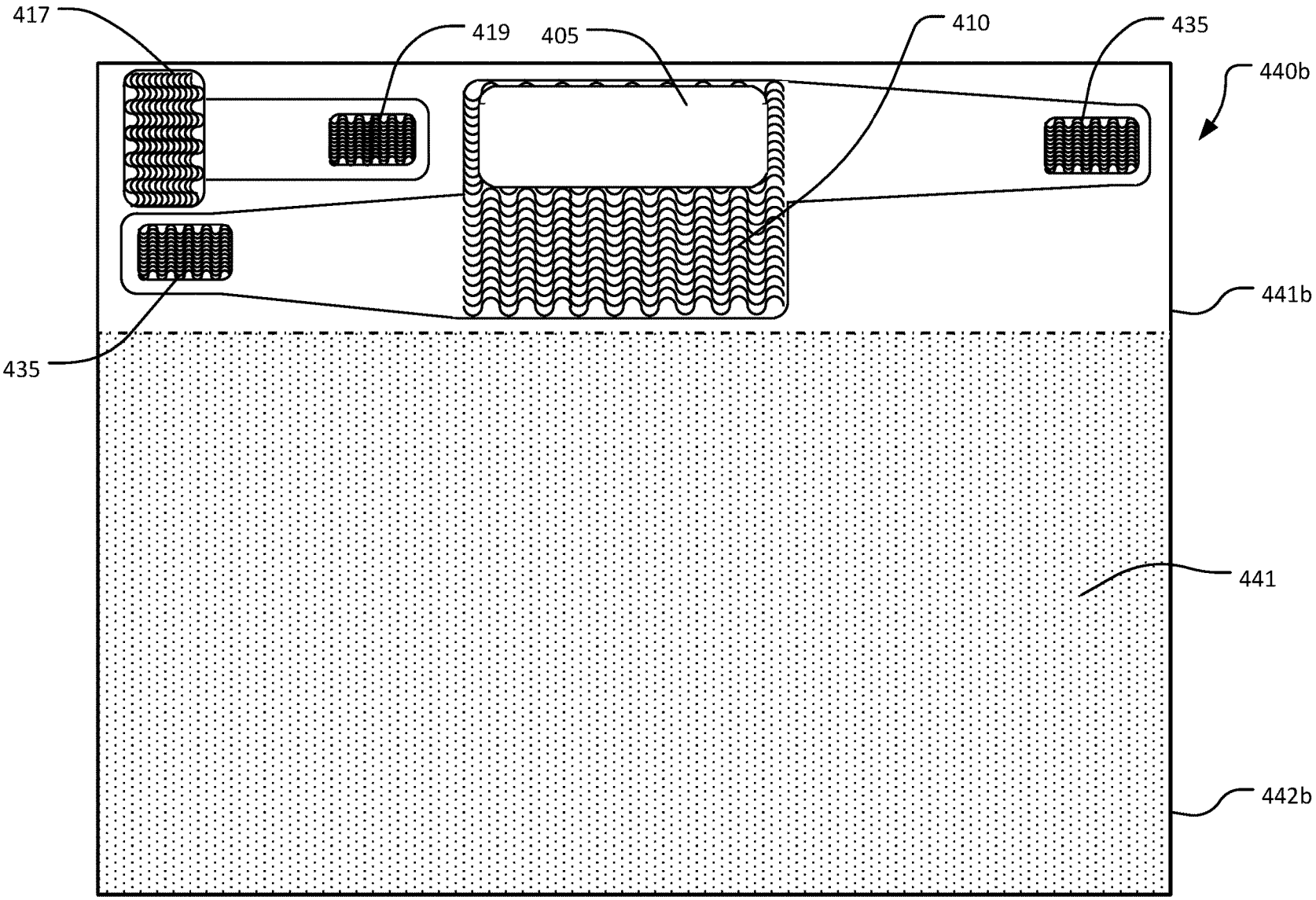
FIG. 11 is a back view of the back side of the combination wristband and label form of FIG. 8.

The adhesive areas 407*b* and 407*a* of the back faces 402*b* and 403*b* may allow adherence of the back side 401*b* of the front sheet 401 to a back side 440*b* of the back sheet 440, illustrated in FIG. 11. To prevent permanent adherence of the back side 440*b* to the back side 401*b*, the back face 402*b* of the top portion 402 may include a layer of silicone in the area corresponding to the die cut wristband 420, and may further include a layer of silicone in the area corresponding to the adhesive area 407*b* (e.g., the adhesive area 407*b* may be applied above the layer of silicone). Alternately, the back face 402*b* may be devoid of silicone in the area corresponding to the adhesive area 407*b* such that the back sheet top portion 441 is substantially permanently adhered to the front sheet top portion 402 in the area of the adhesive 407*b*. In some embodiments, the silicone material (if present) may be applied in a pattern which may allow for a somewhat less permanent adhesion between the back sheet top portion 441 and the front sheet top portion 402 in the areas with patterned silicone. In any event, the area 443 of the back sheet top portion 441 surrounding the die cut wristband 421 (FIG. 10) will preferably remain in place upon removal of the wristband 421 from the form 400.

A bottom portion 442 of the back sheet 440 may be constructed of paper or a synthetic resin, and the back side 442*b* of the bottom portion 442 may include a layer of silicone (or another similar release material) in an area generally corresponding to the adhesive area 407*a*. The layer of release material allows the back sheet 440 to be removably adhered to the front sheet 401. Thus, when combined, the back sheet bottom portion 442 is adhered to the front sheet bottom portion 403 via the adhesive 407*a*. The back sheet bottom portion 442 remains adhered to the front sheet bottom portion 403 until it is removed (or a portion of it is removed) by a user.

As noted briefly above, the back sheet top portion 441 includes a die cut of a wristband 421 (FIG. 10). A die cut of other wristband accessories, such as a wristband extension 421*a*, may additionally be included in the back sheet top portion 441. The wristband 421 may be defined by two laterally opposing sides (or ends) 424 and 428 which may extend directly (e.g., without a transition) from a central portion 422 having an upper portion 422*a* and a lower portion 422*b* separated by an indention 423. The laterally opposing sides (or ends) 424 and 428 may extend from the lower portion 422*b* and the upper portion 422*a*, respectively (or vice versa).

Similar to the other embodiments, the sides 424 and 428 extend directly from a central portion 422, without any transition, such as a shoulder, or other type of transition. With such a configuration, the material required for the wristband 421 may be less than otherwise may be required. Further, the design is sleek, having no protrusions or other unneeded and/or unwanted areas of material extending from the central portion 422 and/or the sides 424 and 428.

The upper portion 422*a* (or the lower portion 422*b*) of the central portion 422 may include a small indicia-receiving area 405 that is removed from the front sheet 401 along with the wristband 421. The indicia-receiving area 405 may comprise a generally opaque printable coating (e.g., ink, paint, etc.) and the wristband may be a one-ply wristband (i.e., the indicia-receiving area 405 may be integral to the wristband); alternately, the indicia-receiving area 405 may comprise paper that is adhesively secured to the wristband and the wristband may be a two-ply wristband. Removal of the wristband 421 may leave a hole in the front sheet 401.

The wristband 421 is configured to be self-laminating to protect the indicia-receiving area 405. Accordingly, adhesive 410 may be applied to the wristband back side 441*b* in an area surrounding the indicia-receiving area 405, as shown in FIG. 11. Adhesive 410 may not be present on the indicia-receiving area 405 itself. Further, adhesive 410 may be applied to the entire, or substantially entire, area of the central portion (either 422*a* or 422*b*) that does not have the indicia-receiving area 405. Upon removal of the wristband 421 from the form 400, the wristband 421 may be folded about the indention 423 such that the adhesive 410 on the central upper portion 422*a* adheres to the adhesive 410 on the central lower portion 422*b* sandwiching the indicia-receiving area 405 therebetween.

The laterally opposed sides 424 and 428 may contain an area of adhesive 435 (FIG. 11) on a backside of the wristband 421. The adhesive 435 may keep the ends 424 and 428 of the wristband 421 secured to the front sheet back side top portion 402*b*. The wristband 421 may be substantially held into position to the front sheet back side top portion 402*b* via the adhesive areas 410 and 435. The wristband 421 may contain no adhesive apart from that described above.

The laterally opposing sides 424 and 428 of the wristband 421 may be generally rectangular. In some embodiments, the sides 424 and 428 are entirely straight, without a taper. Alternately, as shown in the figures, the sides 424 and 428 may gradually taper towards the end and may conclude in a tongue 436. The wristband 420 may alternately have other shapes, as desired. In embodiments, a height of the tongue 436 (e.g., at end 424) may be less than a height of the remainder of the wristband 421 (including being less than the height of the end 428).

The wristband 421 may be further equipped with security slits 430. The security slits 430 may be configured to tear, should the wristband 421 be tampered with after the wristband 421 is applied to a wearer. This may be beneficial to ensure that the wristband 421 remains associated with the intended wearer, particularly in a healthcare environment where the wristband 421 includes patient-specific information.

Similar to the embodiments described above, in addition to the wristband 421, an extension portion 415 may be die cut into the top portion 441 of the backing sheet 440 to allow the wristband 421 to accommodate larger wrists. The extension portion 415 may include a first end 416 having an area of adhesive 417 on the backside thereof. A second end 418 may additionally have an area of adhesive 419 on the backside. Adhesive may not be located between the first and second ends of the extension portion 416 and 418, respectively. The first end 416 may additionally include arms 416*a* and 416*b* extending outwardly from the first end 416, and separated from the first end 416 by lines of perforation 460. Adhesive may be located on the backside of the arms 416*a* and 416*b*. In some embodiments, the arms 416*a* and 416*b* may be separated from the first end 416 by tearing away at the lines of perforation 460. In other embodiments, the extension first end 416 may be aligned with an end 424 or 428 of the wristband 120 and placed thereupon. The arms 416*a* and 416*b* may then be folded about the lines of perforation 460, one at a time, to further secured the extension 415 to the wristband 421. Further, the extension 415 may further incorporate tamper evident slits 430.

The top portion 441 of the back sheet 400 may be constructed of a synthetic material, such as polyester fabric or plastic, for example. Other materials may additionally, or alternately, be appropriate. Those of skill in the art may recognize that it may be beneficial for the wristband 421 material to be resistant to water or other liquid, which may cause the integrity of the wristband 421 to be prematurely compromised.

In use, after the wristband 421 has been printed, the user may remove the wristband 421 from the form 400 as described above regarding embodiments 100, 200, and/or 300.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention. For example, the indicia-receiving area 405 illustrated on the top panel of the wristband may instead be provided on the bottom panel thereof. Or for instance, the form may comprise only one or more wristbands (e.g., one or more laminable single-ply wristbands) without any labels.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

The invention claimed is:

1. A combination wristband and label form, comprising:

a front sheet comprising a label area and a wristband area, said label area including a plurality of labels, said wristband area having a void extending therethrough;

a back sheet opposite said front sheet, said back sheet comprising a label section and a wristband section, said label section corresponding to said label area; and a wristband formed by die cuts in said wristband section, said wristband including a first strap, a second strap, and a central area, said first strap and said second strap each extending laterally away from said central area, each of said first strap and said second strap having adhesive only on an outer edge thereof, said central area comprising a printable portion and a laminating portion foldable over said printable portion to laminate at least a part of said printable portion, said printable portion being coated with an ink configured to receive indicia, said ink facing away from said back sheet and being accessible from said front sheet such that said printable portion is configured to be printed by a printer through said void.

2. The combination wristband and label form of claim 1, wherein said wristband is configured to be separated from said back sheet in one continuous motion.

3. The combination wristband and label form of claim 2, wherein no additional voids are exposed in said combination wristband and label form upon separation of said wristband from said combination wristband and label form.

4. The combination wristband and label form of claim 1, wherein said ink is opaque.

5. The combination wristband and label form of claim 1, wherein said ink is translucent.

6. The combination wristband and label form of claim 1, wherein said wristband separated from said combination wristband and label form is devoid of paper.

7. The combination wristband and label form of claim 1, wherein said wristband separated from said combination wristband and label form is of a unitary construction.

8. The combination wristband and label form of claim 1, further comprising an extender adjacent said central area.

* * * * *